US008847934B2

(12) United States Patent
Yamashita et al.

(10) Patent No.: US 8,847,934 B2
(45) Date of Patent: Sep. 30, 2014

(54) DISPLAYING APPARATUS

(71) Applicant: Canon Kabushiki Kaisha, Tokyo (JP)

(72) Inventors: Takanori Yamashita, Chiba (JP); Masami Iseki, Mobara (JP); Fujio Kawano, Kawasaki (JP); Tatsuhito Goden, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 134 days.

(21) Appl. No.: 13/709,500

(22) Filed: Dec. 10, 2012

(65) Prior Publication Data

US 2013/0155038 A1 Jun. 20, 2013

(30) Foreign Application Priority Data

Dec. 20, 2011 (JP) ..... 2011-278844

(51) Int. Cl.
*G09G 3/32* (2006.01)
*G09G 5/00* (2006.01)

(52) U.S. Cl.
CPC ..... *G09G 3/32* (2013.01); *G09G 3/3291* (2013.01); *G09G 3/3233* (2013.01); *G09G 5/00* (2013.01); *G09G 2300/0861* (2013.01)
USPC ..... 345/204; 345/211; 345/82; 348/222.1

(58) Field of Classification Search
USPC ..... 345/204, 82, 211; 348/222.1
See application file for complete search history.

(56) References Cited

U.S. PATENT DOCUMENTS 5,302,871 A 4/1994 Matsuzaki et al.
5,515,072 A 5/1996 Yanai et al.
5,963,184 A 10/1999 Tokunaga et al.
6,188,378 B1 2/2001 Yamamoto et al.
6,335,720 B1 1/2002 Mori et al.
6,348,910 B1 2/2002 Yamamoto et al.
6,373,454 B1 4/2002 Knapp et al.
6,552,709 B1 4/2003 Yamaguchi
6,559,824 B1 5/2003 Kubota et al.
6,587,086 B1 7/2003 Koyama
6,600,472 B1 7/2003 Nakai et al.
6,661,180 B2 12/2003 Koyama (Continued)

FOREIGN PATENT DOCUMENTS

CN 1521719 A 8/2004
CN 1770246 A 5/2006

(Continued)

*Primary Examiner* — Amare Mengistu
*Assistant Examiner* — Joseph G Rodriguez
(74) *Attorney, Agent, or Firm* — Fitzpatrick, Cella, Harper & Scinto

(57) ABSTRACT

A displaying apparatus having a finer-pitch circuit constitution is provided without deteriorating a displaying quality and increasing each pixel size. In the displaying apparatus which can suppress a characteristic variation of a driving transistor included in each pixel circuit by using a control circuit, the control circuit is arranged on an outer side of a region in which the plurality of pixel circuits are arranged, and there are a second capacitor in which an input data signal is supplied to one end thereof, a first voltage follower circuit of which an input is connected to the other end of the second capacitor and of which an output is connectable to a data line, and a second voltage follower circuit of which an input is connected to the data line and of which an output is connectable to the other end of the second capacitor.

6 Claims, 11 Drawing Sheets

(56) References Cited

U.S. PATENT DOCUMENTS

| | | | |
|---|---|---|---|
| 6,859,193 | B1 | 2/2005 | Yumoto |
| 6,885,029 | B2 | 4/2005 | Miyazawa |
| 7,126,565 | B2 | 10/2006 | Kawasaki et al. |
| 7,187,004 | B2 | 3/2007 | Miyazawa |
| 7,242,397 | B2 | 7/2007 | Iseki et al. |
| 7,253,812 | B2 | 8/2007 | Sasaki |
| 7,259,735 | B2 | 8/2007 | Kasai |
| 7,532,207 | B2 | 5/2009 | Kawasaki et al. |
| 7,605,899 | B2 | 10/2009 | Shikina et al. |
| 7,692,643 | B2 | 4/2010 | Kawasaki et al. |
| 7,812,812 | B2 | 10/2010 | Yoshinaga et al. |
| 7,817,114 | B2 | 10/2010 | Iseki et al. |
| 7,872,617 | B2 | 1/2011 | Yamashita et al. |
| 7,903,053 | B2 | 3/2011 | Kawasaki et al. |
| 7,911,425 | B2 | 3/2011 | Goden et al. |
| 7,969,392 | B2 | 6/2011 | Yamashita et al. |
| 8,154,539 | B2 | 4/2012 | Kawasaki et al. |
| 8,159,482 | B2 | 4/2012 | Kawasaki et al. |
| 8,159,489 | B2 | 4/2012 | Nakamura et al. |
| 8,248,332 | B2 | 8/2012 | Kawasaki et al. |
| 8,305,325 | B2 | 11/2012 | Kawasaki et al. |
| 8,339,336 | B2 | 12/2012 | Goden et al. |
| 8,354,981 | B2 | 1/2013 | Kawasaki et al. |
| 8,390,539 | B2 | 3/2013 | Kawasaki et al. |
| 8,395,570 | B2 | 3/2013 | Maru et al. |
| 8,432,380 | B2 | 4/2013 | Kawasaki et al. |
| 2002/0047581 | A1 | 4/2002 | Koyama |
| 2003/0058687 | A1 | 3/2003 | Kimuara |
| 2003/0132931 | A1 | 7/2003 | Kimura et al. |
| 2003/0214465 | A1 | 11/2003 | Kimura |
| 2004/0155843 | A1 | 8/2004 | Sasaki |
| 2004/0183752 | A1 | 9/2004 | Kawasaki et al. |
| 2005/0007316 | A1 | 1/2005 | Akimoto et al. |
| 2005/0007319 | A1 | 1/2005 | Shin et al. |
| 2005/0007359 | A1 | 1/2005 | Iseki et al. |
| 2005/0041002 | A1 | 2/2005 | Takahara et al. |
| 2005/0122150 | A1 | 6/2005 | Iseki et al. |
| 2005/0285151 | A1 | 12/2005 | Kawasaki |
| 2006/0061529 | A1 | 3/2006 | Kim |
| 2006/0114194 | A1 | 6/2006 | Kawasaki et al. |
| 2006/0114195 | A1 | 6/2006 | Yamashita et al. |
| 2006/0132395 | A1 | 6/2006 | Kawasaki et al. |
| 2006/0145960 | A1 | 7/2006 | Koga et al. |
| 2006/0187185 | A1 | 8/2006 | Yoshinaga et al. |
| 2006/0267509 | A1 | 11/2006 | Yang |
| 2007/0132719 | A1 | 6/2007 | Yamashita et al. |
| 2007/0257867 | A1 | 11/2007 | Kasai |
| 2007/0257868 | A1 | 11/2007 | Kasai |
| 2008/0007494 | A1 | 1/2008 | Kim et al. |
| 2008/0157828 | A1 | 7/2008 | Kawasaki et al. |
| 2008/0158112 | A1 | 7/2008 | Kawasaki et al. |
| 2008/0259000 | A1 | 10/2008 | Kawasaki |
| 2009/0015571 | A1 | 1/2009 | Kawasaki et al. |
| 2009/0033599 | A1 | 2/2009 | Kawasaki et al. |
| 2009/0066615 | A1 | 3/2009 | Kawasaki |
| 2009/0085908 | A1 | 4/2009 | Kawasaki et al. |
| 2009/0102853 | A1 | 4/2009 | Kawasaki et al. |
| 2009/0109144 | A1 | 4/2009 | Goden et al. |
| 2009/0121980 | A1 | 5/2009 | Kawasaki et al. |
| 2009/0135110 | A1 | 5/2009 | Nakamura et al. |
| 2009/0231239 | A1 | 9/2009 | Goden et al. |
| 2009/0289966 | A1 | 11/2009 | Ikeda et al. |
| 2010/0026677 | A1 | 2/2010 | Shikina et al. |
| 2010/0045646 | A1 | 2/2010 | Kishi |
| 2010/0073267 | A1 | 3/2010 | Akimoto et al. |
| 2010/0128160 | A1 | 5/2010 | Maru et al. |
| 2010/0328365 | A1 | 12/2010 | Ikeda et al. |
| 2011/0001689 | A1 | 1/2011 | Maru et al. |
| 2011/0025653 | A1 | 2/2011 | Ikeda et al. |
| 2011/0090210 | A1 | 4/2011 | Sasaki et al. |
| 2011/0187888 | A1* | 8/2011 | Shimizu et al. ..... 348/222.1 |
| 2012/0086742 | A1 | 4/2012 | Ikeda et al. |

FOREIGN PATENT DOCUMENTS

| | | | |
|---|---|---|---|
| EP | 1 429 312 | A2 | 6/2004 |
| JP | 11-282417 | A | 10/1999 |
| JP | 2001-134229 | A | 5/2001 |
| JP | 2001-159877 | A | 6/2001 |
| JP | 2002-517806 | A | 6/2002 |
| JP | 2003-202833 | A | 7/2003 |
| JP | 2003-271095 | A | 9/2003 |
| JP | 2004-126512 | A | 4/2004 |
| JP | 2004-126526 | A | 4/2004 |
| JP | 2004-294850 | A | 10/2004 |
| JP | 2004-341144 | A | 12/2004 |
| JP | 2005-157263 | A | 6/2005 |
| JP | 2006-030516 | A | 2/2006 |
| JP | 2005-157322 | A | 6/2006 |
| JP | 2008-268981 | A | 11/2008 |
| JP | 2008-015516 | A | 12/2008 |
| JP | 2009-008799 | A | 1/2009 |
| WO | 01/06484 | A1 | 1/2001 |
| WO | 01/91094 | A | 11/2001 |
| WO | 2008/108024 | A | 9/2008 |

* cited by examiner

DISPLAYING APPARATUS

BACKGROUND OF THE INVENTION

1. Field of the Invention

The present invention relates to an active-matrix displaying apparatus in which an organic EL (electroluminescence) device serving as a current control device is used.

2. Description of the Related Art

A voltage-programming pixel circuit which sets an input data voltage according to a gradation to be displayed has been known as a pixel circuit to be used for an active-matrix organic EL displaying apparatus. Incidentally, the pixel circuit like this generally comprises a driving transistor for supplying a current based on the input data voltage to an organic EL device. Here, there is a fact that a threshold voltage varies according to the driving transistor to be used. For this reason, there is a problem that, even if the same input data voltage is set to each pixel circuit, a luminance of the organic EL device varies resultingly. Under the circumstance, Japanese Patent Application Laid-Open No. 2003-271095 discloses, as a method of solving the above problem, a voltage-programming pixel circuit which is able to cancel an influence of variation in a threshold voltage of a driving transistor.

That is, in the pixel circuit disclosed in Japanese Patent Application Laid-Open No. 2003-271095 which comprises two transistors and two capacitors, a capacitance of a parasitic capacitor CL which is connected to a current control device in parallel is made larger than a capacitance of a storage capacitor CS which is connected between the gate electrode and the source electrode of the driving transistor. Consequently, since it is possible to reduce a level of an input video signal, such a constitution is advantageous in terms of consumed power.

However, in such a technique as described above, a large layout area is necessary to form a large-capacity capacitor. Further, since the parasitic capacitor CL is provided for each pixel circuit, a region which is necessary to provide the parasitic capacitor in each pixel circuit becomes large, whereby there is a problem that it is difficult to provide a finer-pitch (more precise) pixel circuit.

SUMMARY OF THE INVENTION

Consequently, an object of the present invention is to provide a displaying apparatus which can achieve a finer pitch and more precise circuit constitution without deteriorating a displaying quality and increasing a region necessary for each pixel circuit.

To achieve the above object, there is provided, according to the present invention, a displaying apparatus which comprises a plurality of pixel circuits, a data line configured to supply a voltage to the plurality of pixel circuits, and a control circuit connected to the data line, wherein each of the plurality of pixel circuits includes a light emitting device, a driving transistor configured to supply to the light emitting device a current according to the voltage applied to a gate electrode thereof, a first capacitor of which one end is connected to the gate electrode of the driving transistor, a first switch transistor configured to control conduction between the gate electrode of the driving transistor and the data line, and a second switch transistor configured to control conduction between a drain electrode of the driving transistor and the data line, and the control circuit is arranged on an outer side of a region in which the plurality of pixel circuits are arranged, and the control circuit includes a second capacitor in which an input data signal is supplied to one end thereof, a first voltage follower circuit of which an input is connected to the other end of the second capacitor and of which an output is connectable to the data line, and a second voltage follower circuit of which an input is connected to the data line and of which an output is connectable to the other end of the second capacitor.

According to the present invention, since the displaying apparatus is not affected by the variation in the threshold voltage of the driving transistor, it is possible to provide the displaying apparatus which does not deteriorate the displaying quality. Further, since the capacitor to be provided for each pixel circuit does not become large, it is possible to provide the displaying apparatus which can achieve the finer-pitch constitution without enlarging the region necessary for each pixel circuit.

Further features of the present invention will become apparent from the following description of exemplary embodiments with reference to the attached drawings.

DESCRIPTION OF THE EMBODIMENTS

Hereinafter, exemplary embodiments of the present invention will be concretely described with reference to the attached drawings. Here, it should be noted that each of the following embodiments is preferably applied to an active-matrix displaying apparatus which uses an organic EL device.

Figure 1:
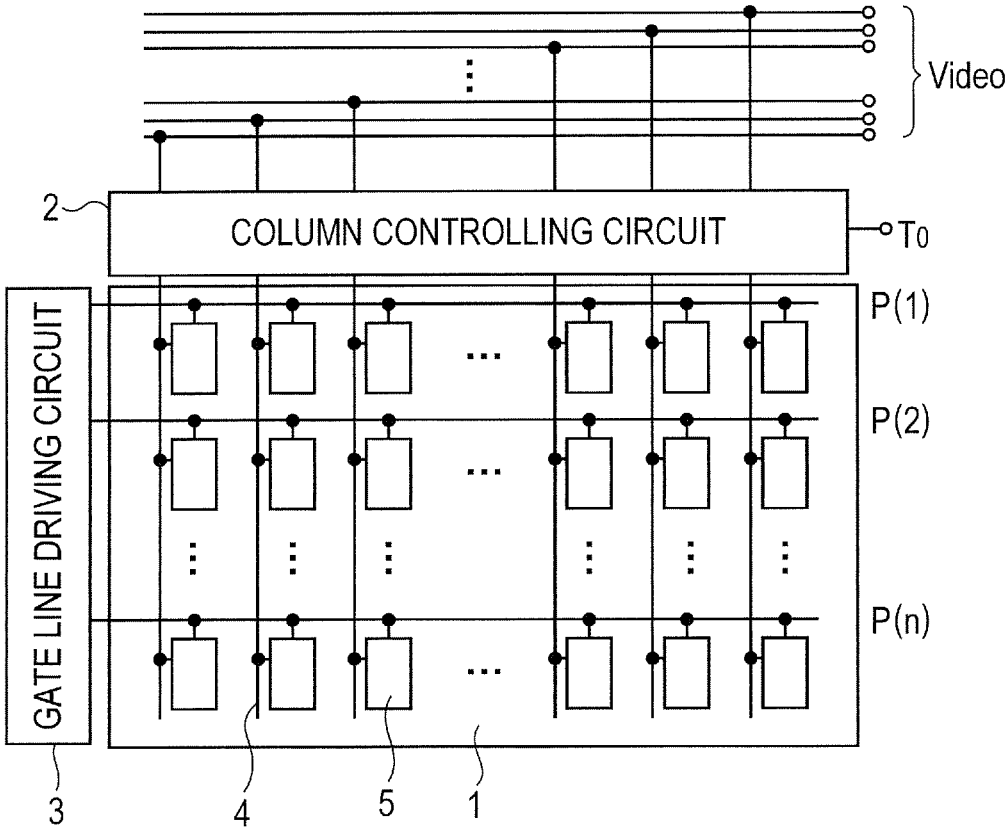
FIG. 1 is a schematic block diagram illustrating an entire constitution of a displaying apparatus to which the present invention is applied.

FIG. 1 is a schematic block diagram illustrating an entire constitution of an active-matrix organic EL displaying apparatus to which the present invention is applied. As illustrated in the drawing, a displaying region 1 is formed on a substrate, and a plurality of pixel circuits 5 arranged like a matrix are provided in the displaying region 1. Further, each of the pixel circuits 5 includes a light emitting device, and an organic EL device, an inorganic EL device, an LED (light emitting diode) and the like can be used as the light emitting device. An input data signal (Video) is input from an external circuit (not illustrated) to a control circuit 2 (hereinafter, called a column control circuit 2) through a plurality of video signal lines. The column control circuit 2, which is placed outside the displaying region 1, controls an output voltage to a plurality of data lines 4 in response to a $T_0$ control signal input from the external circuit. A gate line driving circuit 3 supplies P control signal lines (P(1), P(2), . . . , P(n); "n" is a natural number) to the plurality of pixel circuits 5 for corresponding rows respectively. In an example illustrated in FIG. 1, the input data signal, the $T_0$ control signal, and the P control signals are supplied from the external circuit. However, the present invention is not limited to such a constitution. Namely, for example, an output signal which is supplied from a controller installed on the same substrate by a COG (chip on glass) method may be supplied as the input data signal and the control signal.

First Embodiment

Figure 2:
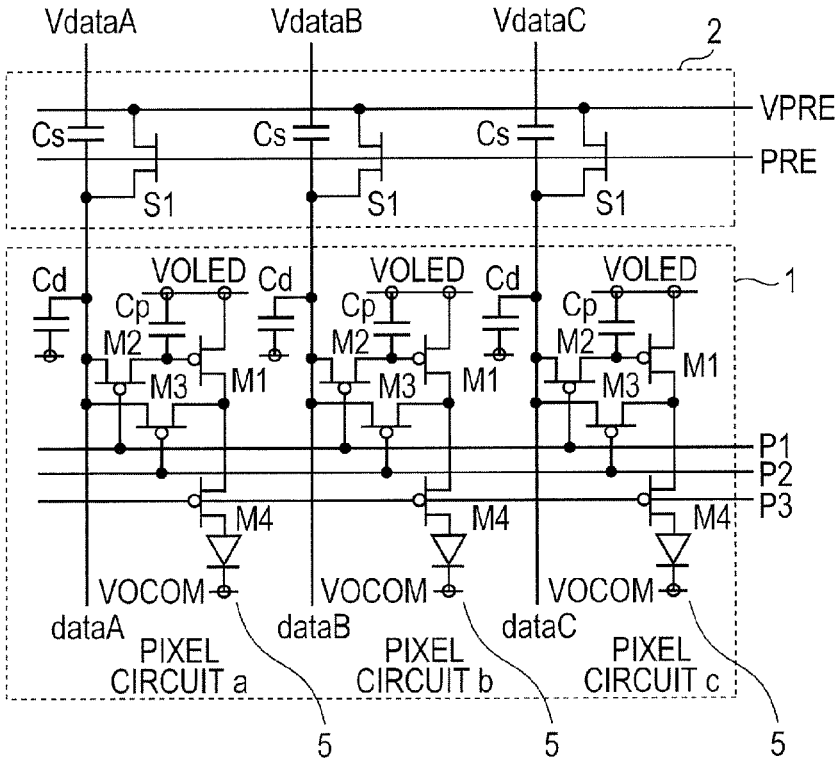
FIG. 2 is a block diagram illustrating a pixel circuit and a control circuit which are used in a first embodiment of the present invention.

FIG. 2 is a block diagram illustrating constitutions of a column control circuit 2, and three-column and one-row pixel circuits 5 (pixel circuits a, b, c) in a displaying region 1, according to the first embodiment.

One block in the column control circuit 2 is arranged for each column, and includes one capacitor (column control capacitor Cs) and one transistor (switch transistor S1). A video signal line Vdata through which the input data signal (input data voltage) is supplied is connected to one end of the column control capacitor Cs (second capacitor). One of the source and the drain of the switch transistor S1 is connected to the other end of the column control capacitor Cs and a data line (dataA, dataB, dataC). The gate of the switch transistor S1 is connected to a PRE control signal line. The other of the source and the drain of the switch transistor S1 is connected to a precharge voltage line VPRE. Incidentally, it should be noted that the switch transistor S1 is not indispensable as the constituent element of the present invention.

Each of the pixel circuits 5 includes an organic EL device, a driving transistor M1, a storage capacitor Cp (first capacitor), a switch transistor M2 (first switch transistor) and a switch transistor M3 (second switch transistor). The driving transistor M1 supplies a current according to a voltage applied to the gate electrode to the organic EL device. The storage capacitor Cp, of which one end is connected to the gate electrode of the driving transistor M1, stores the voltage applied to the gate electrode. The switch transistor M2 controls conduction between the gate electrode of the driving transistor M1 and the data line, and the switch transistor M3 controls conduction between the gate electrode and the drain electrode of the driving transistor M1 through the switch transistor M2.

One of the source and the drain of the driving transistor M1 is connected to a current supply line VOLED. The gate of the driving transistor M1 is connected to one end of the storage capacitor Cp of which the other end is connected to the current supply line VOLED, and further to one of the source and the drain of the switch transistor M2 in which the other of the source and the drain is connected to the data line. The other of the source and the drain of the driving transistor M1 is connected to one of the source and the drain of the switch transistor M3 in which the other of the source and the drain is connected to the data line. The drain of the driving transistor M1 is further connected to one of the source and the drain of a switch transistor M4 in which the other of the source and the drain is connected to the anode of the organic EL device. The cathode of the organic EL device is connected to a common potential VOCOM which is provided in common for all the pixel circuits. The gate of the switch transistor M2 is connected to a P1 control signal line, the gate of the switch transistor M3 is connected to a P2 control signal line, and the gate of the switch transistor M4 is connected to a P3 control signal line.

The data line is used to supply the voltage to be applied to the other end of the column control capacitor Cs. Further, the data line is connected to a data line capacitor Cd which is formed by an intersection between the data line and a row control line, an adjacent wiring, and the like.

In the present embodiment, an NMOS (N-channel metal oxide semiconductor) is used as the transistor which constitutes the column control circuit 2, and a PMOS (P-channel metal oxide semiconductor) is used as the transistor which constitutes the pixel circuit 5. However, in the present invention, the polarities of the transistors which constitute the column control circuit 2 and the pixel circuit 5 are not limited to them. Namely, the single-channel MOS such as the NMOS or the PMOS may be used for each of all the transistors which constitute the column control circuit 2 and the pixel circuit 5. Moreover, a mixture constitution including the NMOS and the PMOS may be used for each of all the transistors which constitute the column control circuit 2 and the pixel circuit 5.

Figure 3:
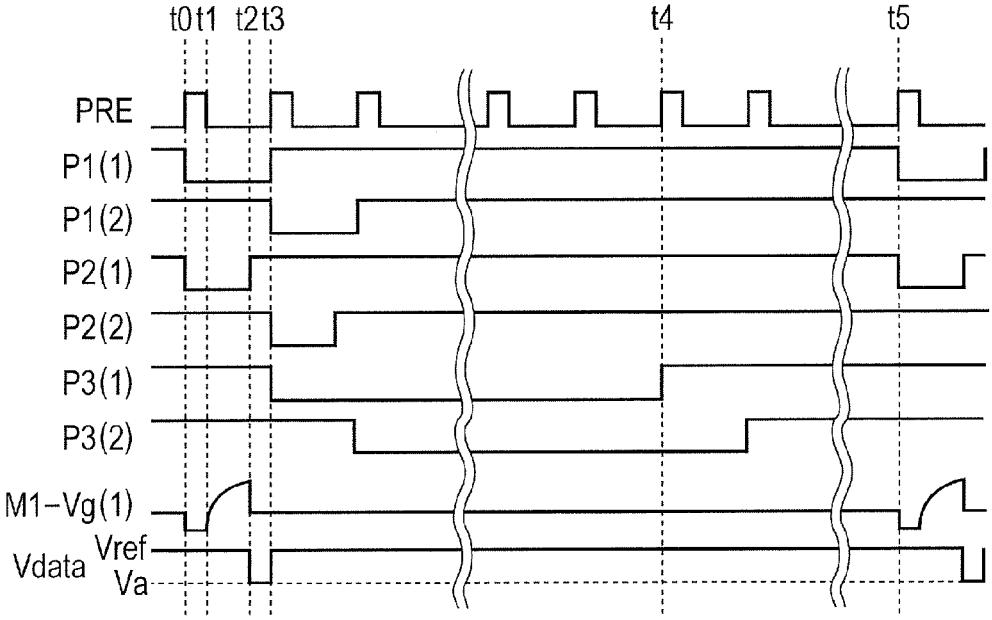
FIG. 3 is a timing chart corresponding to the pixel circuit and the control circuit of FIG. 2 in the first embodiment of the present invention.

Subsequently, a concrete circuit operation according to the present embodiment will be described with reference to a timing chart illustrated in FIG. 3. Here, it is assumed that the control signals to be input to the pixel circuits in the first row are represented by P1(1), P2(1) and P3(1) control signals, and the control signals to be input to the pixel circuits in the second row are represented by P1(2), P2(2) and P3(2) control signals.

First, the pixel circuits in the first row will be described. In the period from a time t0 until just before a time t1, the P1(1) control signal and the P2(1) control signal are at an L (low) level, and the P3(1) control signal is at an H (high) level. In other words, the switch transistors M2 and M3 are on, and the switch transistor M4 is off. In the column control circuit 2, a reference voltage (Vref) serving as an input data voltage is input to one end of the column control capacitor Cs. Further, since the PRE control signal line is at the H level and the switch transistor S1 is on, the other end of the column control capacitor Cs and the data line are set to a precharge voltage (VPRE). Furthermore, the gate and the drain of the driving transistor M1 are in a short circuit condition, and are set to the precharge voltage (VPRE) through the data line. Incidentally, the within-named precharge voltage implies the voltage by which the driving transistor M1 is set to a driving state. More specifically, the precharge voltage is equivalent to the voltage by which the gate-source voltage of the driving transistor M1 is made sufficiently higher than the threshold voltage (Vth) of the driving transistor M1. At this time, since a current is not supplied to the organic EL device because the switch transistor M4 is off, the organic EL device does not emit light [precharge period].

In the period from the time t1 until just before a time t2, since the PRE control signal changes from the H level to the L level, the switch transistor S1 becomes off. At this time, the current, which flows in the driving transistor M1 according to the gate voltage, flows from the drain to the gate of the driving transistor M1 whereby the gate voltage and the drain voltage of the driving transistor M1 and the data line voltage are increased. The current flowing in the driving transistor M1 decreases with the increase in the gate potential of the driving transistor M1. During the period until the time t2 at which the current from the driving transistor M1 hardly flows, the storage capacitor Cp, the data line capacitor Cd and the column control capacitor Cs are charged according to a quantity of the current flowing into the gate of the driving transistor M1. Then, at the time t2, since the P2(1) control signal changes from the L level to the H level, the switch transistor M3 becomes off. Thus, the gate voltage, i.e., the threshold voltage (Vth), at the time when the current does not flow in the driving transistor M1 is set to the storage capacitor Cp and the data line capacitor Cd [auto-zero period].

In the period from the time t2 until just before a time t3, the input data voltage changes from the reference voltage (Vref) to a Va voltage serving as a gradation voltage (a difference voltage $\Delta V=Va-Vref$). Consequently, the input data voltage is written to the gate of the driving transistor M1 and stored in the storage capacitor Cp at a capacitance division ratio by the parallel capacitances of the column control capacitor Cs, the data line capacitor Cd and the storage capacitor Cp. Incidentally, the gate-source voltage of the driving transistor M1 is given by $Vgs=\{Cs/(Cs+Cd+Cp)\}\cdot\Delta V+Vth$ [voltage programming period].

Then, at the time t3, since the P3(1) control signal changes from the H level to the L level, the switch transistor M4 becomes on. Thus, the driving transistor M1 starts supplying, to the organic EL device, the current according to the gate-source voltage. In other words, the organic EL device starts emitting light [light emission period].

At the time t4, since the P3(1) control signal changes from the L level to the H level, the switch transistor M4 changes from on to off. Thus, the driving transistor M1 stops supplying the current to the organic EL device, whereby the organic EL device comes to be in a state of not emitting light [non-emission period]. In other words, the organic EL device is in the light emission state from the time t3 until just before the time t4, and is then in the non-emission state after the time t4. Therefore, the light emission period and the non-emission period can be properly set by arbitrarily setting the time t4.

At a time t5, since the P1(1) control signal and the P2(1) control signal change from the H level to the L level, the switch transistors M2 and M3 change from off to on. Thus, in the column control circuit 2, the reference voltage (Vref) serving as the input data voltage is input to one end of the column control capacitor Cs. Further, since the PRE control signal is at the H level and the switch transistor S1 is on, the other end of the column control capacitor Cs and the data line are set to the precharge voltage VPRE. Furthermore, the gate and the drain of the driving transistor M1 are in the short circuit condition, and are set to the precharge voltage (VPRE) through the data line, whereby the precharge period is set. After then, the auto-zero period, the voltage programming period, the light emission period and the non-emission period are sequentially repeated.

Subsequently, the pixel circuits in the second row will be described. At the time t3 at which the pixel circuits in the first row start emitting light, since the P1(2) control signal changes from the H level to the L level and the P2(2) control signal changes from the H level to the L level, the switch transistors M2 and M3 change from off to on. Namely, the gate and the drain of the driving transistor M1 are in the short circuit condition, and are set to the precharge voltage (VPRE) through the data line, whereby the precharge period is set. After then, the auto-zero period, the voltage programming period, the light emission period and the non-emission period are sequentially repeated. In other words, the precharge period, the auto-zero period, the voltage programming period, the light emission period and the non-emission period are set for each row.

According to the present embodiment, since the data voltage is written to the gate electrode of the driving transistor M1 after the threshold voltage of the driving transistor M1 was stored in the storage capacitor Cp, the apparatus is not affected by the variation in the threshold voltage of the driving transistor M1. For this reason, it is possible to provide the displaying apparatus which does not deteriorate the displaying quality. Further, since the capacitor to be provided in the pixel circuit is only the storage capacity Cp, the capacitor (capacitance) to be provided for each pixel circuit does not become large. Thus, it is possible to provide the displaying apparatus which can achieve the finer-pitch constitution without enlarging the region necessary for each pixel circuit.

Incidentally, the point to be noticed here is that the pixel circuits connected in the same row perform the precharge operation, the auto-zero operation and the voltage programming operation by using in common the column control circuit 2 for each row. In any case, it may be possible to adopt a constitution that the switch transistors M2 of the plurality of pixel circuits are connected in common to the data line, for example, a constitution that the switch transistors M2 of the pixel circuits are connected to the different data line for each column or each row. Thus, it is possible to reduce the number of the circuit devices necessary for each pixel circuit as many as the number of the circuit devices to be used in common by the plurality of pixel circuits. In other words, since the region which is necessary for the pixel circuits can be made small, it is possible to achieve the displaying apparatus having the finer-pitch circuit constitution.

Incidentally, the constitution of the pixel circuit 5 in the present embodiment is not limited to that illustrated in FIG. 2. Namely, one of the source and the drain of the switch transistor M3 may be connected to the gate of the driving transistor M1, the other end of the storage capacitor Cp and the other of the source and the drain of the switch transistor M2.

Second Embodiment

Figure 4:
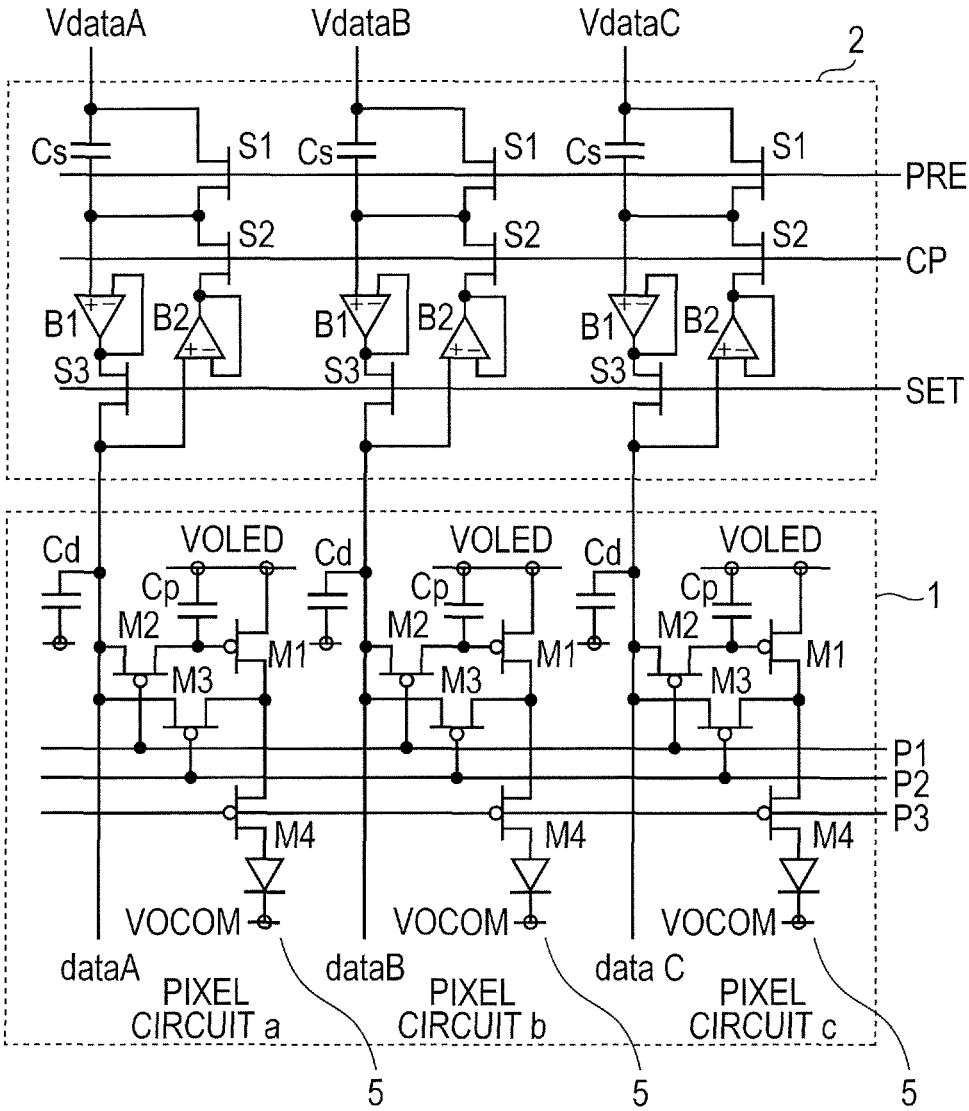
FIG. 4 is a block diagram illustrating a pixel circuit and a control circuit which are used in a second embodiment of the present invention.

FIG. 4 is a block diagram illustrating constitutions of a column control circuit 2, and three-column and one-row pixel circuits 5 (pixel circuits a, b, c) in a displaying region 1, according to the second embodiment.

One block in the column control circuit 2 is arranged for each column, and includes one capacitor (column control capacitor Cs), three transistors (switch transistors S1, S2, S3) and two voltage follower circuits (B1, B2). A video signal line Vdata through which an input data signal is supplied is connected to one of the source and the drain of the switch transistor S1, and one end of the column control capacitor Cs. The other of the source and the drain of the switch transistor S1 is connected to the other end of the column control capacitor Cs, one of the source and the drain of the switch transistor S2, and the input terminal of the voltage follower circuit B1. The output terminal of the voltage follower circuit B1 is connected to one of the source and the drain of the switch transistor S3. The other of the source and the drain of the switch transistor S3 is connected to the data line, and the input terminal of the voltage follower circuit B2. The output terminal of the voltage follower circuit B2 is connected to the other of the source and the drain of the switch transistor S2. Here, it should be noted that the pixel circuit 5 has the same constitution as that described in the first embodiment.

Figure 5:
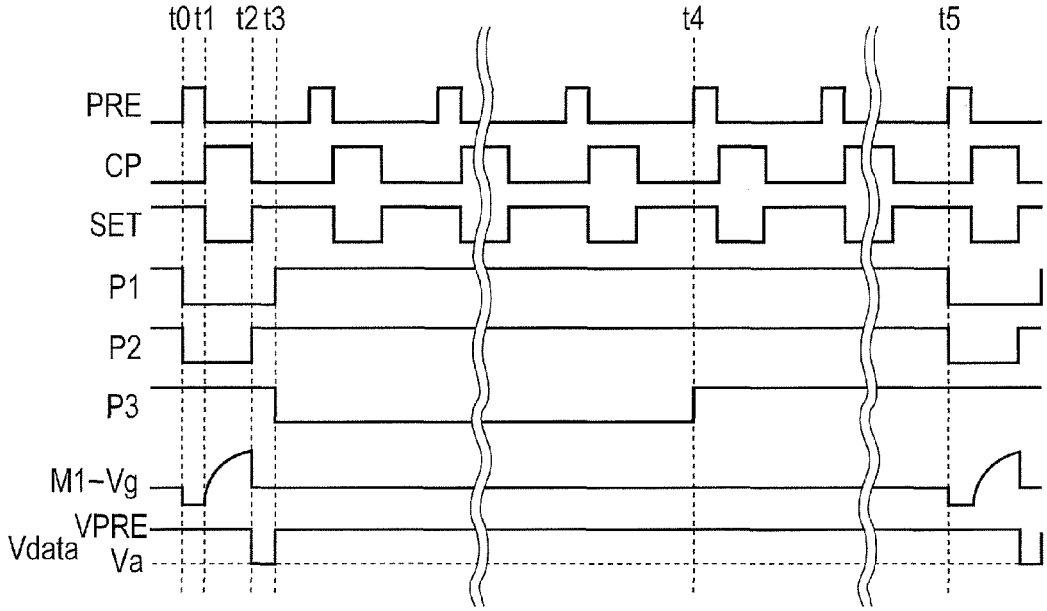
FIG. 5 is a timing chart corresponding to the pixel circuit and the control circuit of FIG. 4 in the second embodiment of the present invention.

Subsequently, a concrete circuit operation according to the present embodiment will be described with reference to a timing chart illustrated in FIG. 5. Here, the circuit operation will be described by focusing attention to the single pixel circuit.

In the period from a time t0 until just before a time t1, a PRE control signal line and a SET control signal line are at an H level, and a CP control signal line is at an L level. That is, the switch transistors S1 and S3 are on, and the switch transistor S2 is off. In the pixel circuit 5, a P1 control signal and a P2 control signal are at the L level, and a P3 control signal is at the H level. In other words, switch transistors M2 and M3 are on, and a switch transistor M4 is off. At this time, a precharge voltage (VPRE) is supplied from the video signal line Vdata. Consequently, both the ends of the column control capacitor Cs are reset, and at the same time the precharge voltage is set to the gate and the drain of a driving transistor M1 through the switch transistor S1, the voltage follower circuit B1, the switch transistor S3 and the data line. At this time, since a current is not supplied to an organic EL device because the switch transistor M4 is off, the organic EL device does not emit light [precharge period].

In the period from the time t1 until just before a time t2, since the PRE control signal line and the SET control signal line change from the H level to the L level, and the CP control signal line changes from the L level to the H level. That is, the switch transistors S1 and S3 change from on to off, and the switch transistor S2 changes from off to on. The states of the three control signal lines (P1, P2, P3) at the time t0 are maintained. At this time, a storage capacitor Cp and a data line capacitor Cd are charged according to a quantity of the current flowing to the gate of the driving transistor M1 until the current from the driving transistor M1 does not flow. Consequently, the gate potential and the drain potential of the driving transistor M1 and the data line potential increase. Then, at the time t2, since the P2 control signal changes from the L level to the H level, the switch transistor M3 changes from on to off. In other words, a threshold voltage (Vth) of the driving transistor M1 is set to the storage capacitor Cp and the data line capacitor Cd. Further, the threshold voltage is set to a voltage Vd of the other end of the column control capacitor Cs through the data line, the voltage follower circuit B2 and the switch transistor S2 (Vd=Vth) [auto-zero period].

In the period from the time t2 until just before a time t3, the CP control signal line changes from the H level to the L level, and the SET control signal line changes from the L level to the H level. The state of the PRE control signal line at the time t1 is maintained. That is, the switch transistors S1 and S2 are off, and the switch transistor S3 is on. In the pixel circuit, the P2 control signal line changes from the L level to the H level, and the states of the P1 control signal line and the P3 control signal line at the time t1 are maintained. That is, the switch transistor M2 is on, and the switch transistors M3 and M4 are off. At this time, an input data voltage changes from a VPRE voltage to a Va voltage serving as a gradation voltage. Consequently, the voltage at the one end of the column control capacitor Cs changes from the VPRE voltage to the Va voltage according to a gradation, as much as a ΔV voltage (=Va−VPRE). That is, the other end of the column control capacitor Cs has a voltage obtained by adding the ΔV voltage the Vth voltage (Vd=Vth+ΔV). Then, the voltage Vd of the other end of the column control capacitor Cs is written to the gate of the driving transistor M1 through the voltage follower circuit B1 and the data line, and is further stored in the storage capacitor Cp [voltage programming period].

At the time t3, the states of the three control signal lines (PRE, CP, SET) at the time t2 are maintained. In the pixel circuit, the P3 control signal line changes from the H level to the L level, and the P1 control signal line changes from the L level to the H level, and the state of the P2 control signal line at the time t2 is maintained. That is, the switch transistors M2 and M3 are off, and the switch transistor M4 is on. Thus, the driving transistor M1 starts supplying, to the organic EL device, the current according to the gate-source voltage. In other words, the organic EL device starts emitting light [light emission period].

At a time t4, since the P3 control signal changes from the L level to the H level, the switch transistor M4 changes from on to off. Thus, the driving transistor M1 stops supplying the current to the organic EL device, whereby the organic EL device comes to be in a state of not emitting light [non-emission period]. In this way, the precharge period, the auto-zero period, the voltage programming period, the light emission period and the non-emission period are set for each row.

In the present embodiment, it is possible by the circuit constitution and the circuit driving method both described above to have the same effect as that in the first embodiment. Moreover, in the present embodiment, since the voltage follower circuit B1 is arranged, impedance on the input side of the voltage follower circuit B1 can be converted by impedance conversion into low impedance on the basis of the output of the voltage follower circuit. Therefore, the ΔV voltage (=Va−VPRE) corresponding to the change quantity of the input data voltage is directly written to the gate of the driving transistor M1 and the storage capacitor Cp without being attenuated. This is the point which is different from the first embodiment. In any case, it is effective by this point to lower the voltage of the control circuit which supplies the input data voltage.

Further, it is possible in the present embodiment to reduce the capacitance of the capacitor to be charged in the auto-zero operation, as compared with the first embodiment. More specifically, in the present embodiment, it becomes unnecessary to charge the column control capacitor Cs in the auto-zero operation, because the voltage follower circuit B2 is arranged so that the threshold voltage (Vth) of the driving transistor M1 held in the data line capacitor Cd can be directly set to the other end of the column control capacitor Cs through the voltage follower circuit B2. For this reason, since the capacitance of the capacitor to be charged in the auto-zero operation can be reduced, it is possible to shorten a time necessary for the auto-zero operation. In other words, even when the time allotted for one row in the displaying apparatus having the finer-pitch circuit constitution is reduced, it is possible to secure a sufficient auto-zero time.

Third Embodiment

Figure 6:
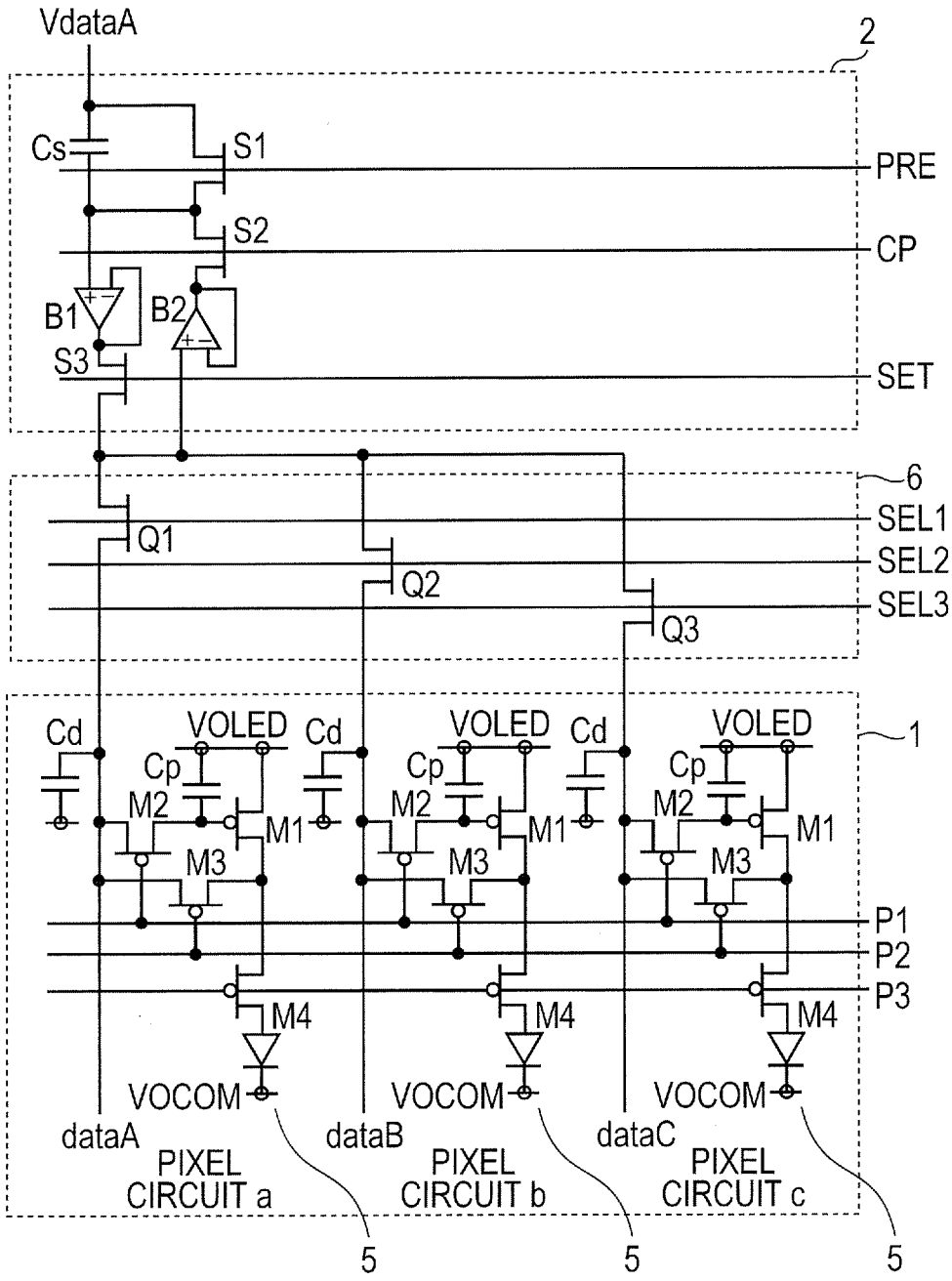
FIG. 6 is a block diagram illustrating a pixel circuit and a control circuit which are used in third and fourth embodiments of the present invention.
Figure 7:
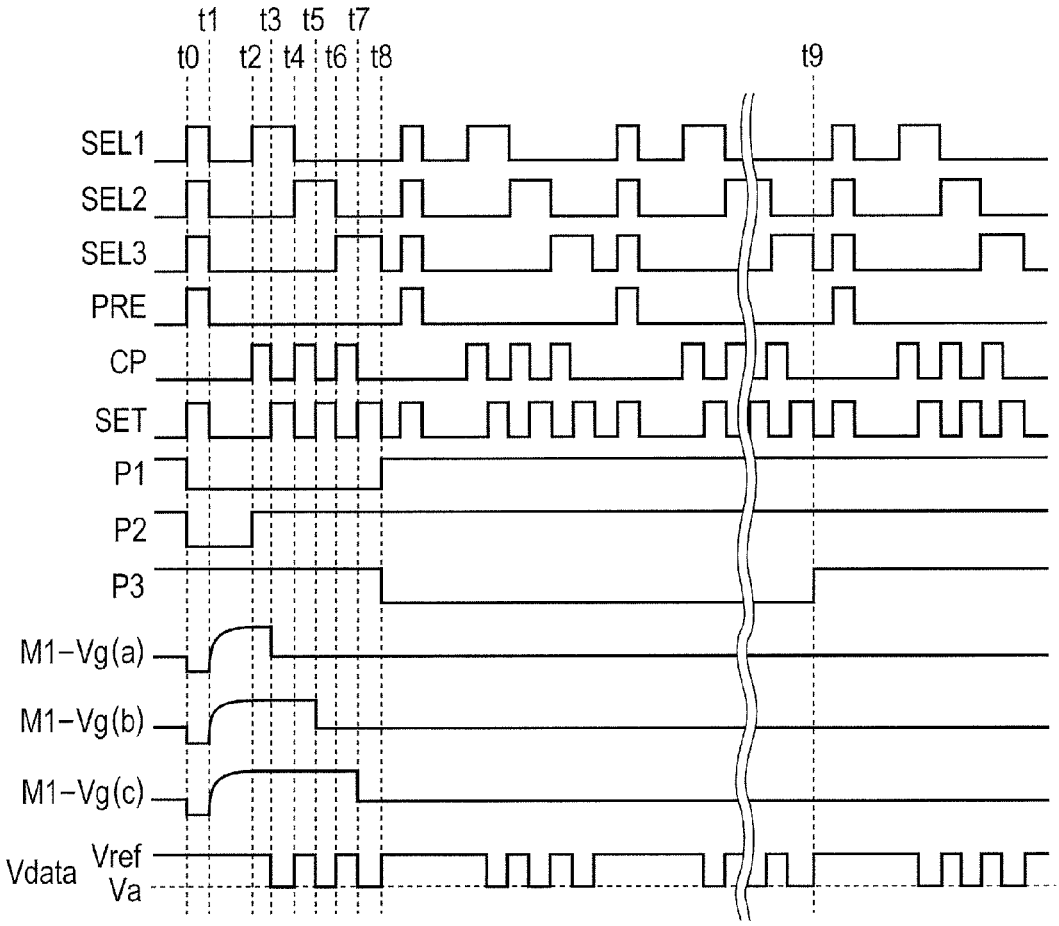
FIG. 7 is a timing chart corresponding to the pixel circuit and the control circuit of FIG. 6 in the third embodiment of the present invention.

FIG. 6 is a block diagram illustrating constitutions of a column control circuit 2, and three-column and one-row pixel circuits 5 (pixel circuits a, b, c) in a displaying region 1, according to the third embodiment. Further, FIG. 7 is a timing chart according to the third embodiment. Hereinafter, the points of the present embodiment different from the above embodiments will be described.

Namely, the present embodiment is different from the first embodiment in the point that one block in the column control circuit 2 includes one capacitor, three transistors and two voltage follower circuits, and uses them in common through three data lines. Further, the present embodiment is different from the first embodiment in the point that a switch circuit 6 (switches Q1, Q2, Q3) is provided between the three data lines and the column control circuit 2, and one of the three data lines is selected and connected to the column control circuit 2.

In the period from a time t0 until just before a time t1, SEL1, SEL2 and SEL3 control signal lines are all at an H level, the switches Q1, Q2 and Q3 are on, and conduction between the column control circuit 2 and three data lines dataA, dataB and dataC are established. In such a state, precharge operations are performed simultaneously to the three pixel circuits a, b and c. In the period from the time t1 until just before a time t2, the SEL1, SEL2 and SEL3 signal lines are all at an L level, the switches Q1, Q2 and Q3 are off, and the column control circuit 2 is separated from the data lines dataA, dataB and dataC. At the same time, in the three pixel circuits a, b and c capable of being connected to the common column control circuit 2, P1 and P2 control signals become the L level, switch transistors M2 and M3 become on, and auto-zero operations are performed simultaneously in these pixel circuits. Then, a threshold voltage (Vth) of a driving transistor M1 of each pixel circuit is set to and stored in a storage capacitor Cp of each pixel circuit and a data line capacitor Cd of each data line.

In the period from the time t2 until just before a time t4, the SEL1 control signal line is at the H level, and the SEL2 control signal line and the SEL3 control signal line are at the L level, whereby the column control circuit 2 is in the state being connected to the data line dataA. Therefore, in the period from the time t2 until just before a time t3, the threshold voltage of the driving transistor M1 of the pixel circuit a is written to the other end of a column control capacitor Cs through a voltage follower circuit B2. Then, in the period from the time t3 until just before the time t4, a gradation voltage to be written to the pixel circuit a is supplied to a signal line VdataA, whereby a voltage programming operation is performed to the pixel circuit a.

In the period from the time t4 until just before a time t6, the SEL2 control signal line is at the H level, and the SEL1 control signal line and the SEL3 control signal line are at the L level, whereby the column control circuit 2 is in the state being connected to the data line dataB. Therefore, in the period from the time t4 until just before a time t5, the threshold voltage of the driving transistor M1 of the pixel circuit b is written to the other end of the column control capacitor Cs through the voltage follower circuit B2. Then, in the period from the time t5 until just before the time t6, a gradation voltage to be written to the pixel circuit b is supplied to the signal line VdataA, whereby a voltage programming operation is performed to the pixel circuit b.

In the period from the time t6 until just before a time t8, the SEL3 control signal line is at the H level, and the SEL1 control signal line and the SEL2 control signal line are at the L level, whereby the column control circuit is in the state being connected to the data line dataC. Therefore, in the period from the time t6 until just before a time t7, the threshold voltage of the driving transistor M1 of the pixel circuit c is written to the other end of the column control capacitor Cs through the voltage follower circuit B2. Then, in the period from the time t7 until just before the time t8, a gradation voltage to be written to the pixel circuit c is supplied to the signal line VdataA, whereby a voltage programming operation is performed to the pixel circuit c.

At the time t8, the column control circuit 2 is separated from the data lines dataA, dataB and dataC. Consequently, in the three pixel circuits a, b and c, a P3 control signal becomes the L level, and a switch transistor M4 becomes on. Thus, the organic EL devices in the three pixel circuits emit light respectively, and the currents according to the gate voltages of the driving transistors M1 of the respective pixel circuits continue to flow in the organic EL devices. Then, at a time t9, the P3 control signal becomes the H level and the switch transistor M4 becomes off, whereby an operation of stopping emitting light is performed. Each organic EL device continues to emit light until this operation. In this way, a precharge period, an auto-zero period, a voltage programming period, a light emission period and a non-emission period are set for each row.

In the present embodiment, it is possible by the circuit constitution and the circuit driving method both described above to have the same effect as that in the first embodiment. Moreover, in the present embodiment, since the voltage follower circuit B2 is arranged in the column control circuit 2 and the column control circuit 2 and each of the data lines are mutually connected through the switch circuit 6, it is possible to selectively set the threshold voltage of the driving transistor M1 of each of the pixel circuits held in each of the data line capacitors Cd to the other end of the column control capacitor Cs.

As described above, in the period from the time t1 until just before the time t2, the auto-zero operations are performed simultaneously to the plurality of pixel circuits in the state that the switches Q1, Q2 and Q3 are off, and the threshold voltage (Vth) of the driving transistor M1 of each of the pixel circuits is set to and stored in the storage capacitor Cp of each of the pixel circuits and the data line capacitor Cd of each of the data lines. At this time, the threshold voltages respectively stored in the storage capacitor Cp of each of the pixel circuits and the data line capacitor Cd of each of the data lines are mutually different according to characteristic of the driving transistor M1. After then, in the period from the time t2 until just before the time t8, when the voltage programming operation is performed for each of the pixel circuits, the threshold voltages are sequentially written to the other end of the column control capacitor Cs through the voltage follower circuit B2. In this case, if the voltage follower circuit B2 is not provided in the column control circuit 2, the voltage is influenced by the quantity of the charge held and stored in the column control capacitor Cs in the previous period and the capacitance division of the capacitors Cs, Cp and Cd, whereby the voltage which is deviated from the original threshold voltage is set to the other end of the column control capacitor Cs.

That is, by arranging the voltage follower circuit B2 in the column control circuit 2 and connecting the column control circuit 2 and each data line through the switch circuit 6, it is possible to cause the single video signal line Vdata and the column control circuit 2 to operate in common for the three data lines. Consequently, it is possible to reduce the number of the wirings for the video signal line, the size of an external circuit provided outside a panel to which the output end of the video signal line is connected, and the number of pads to be used to connect the video signal line to the driver in the panel. Also, it is possible to reduce the number of the blocks in the column control circuit 2, whereby the present embodiment is effective for narrowing the frame of the panel.

Incidentally, it should be noted that the present invention is not limited to the constitution that the single video signal line Vdata and the single column control circuit 2 are shared by the three data lines. Namely, the video signal line and the column control circuit may be shared by two or more data lines.

Further, in the present embodiment, the precharge and auto-zero operations are simultaneously performed for the three pixel circuits respectively having the different data lines. Therefore, since it is unnecessary to perform the precharge operation and the auto-zero operation to the pixel circuit of each of the data lines, it is possible to secure more longer precharge time and auto-zero time. For this reason, even if the time allotted for one row in the displaying apparatus having the finer-pitch circuit constitution is reduced, it is possible to secure sufficient precharge time and auto-zero time.

Fourth Embodiment

Figure 8:
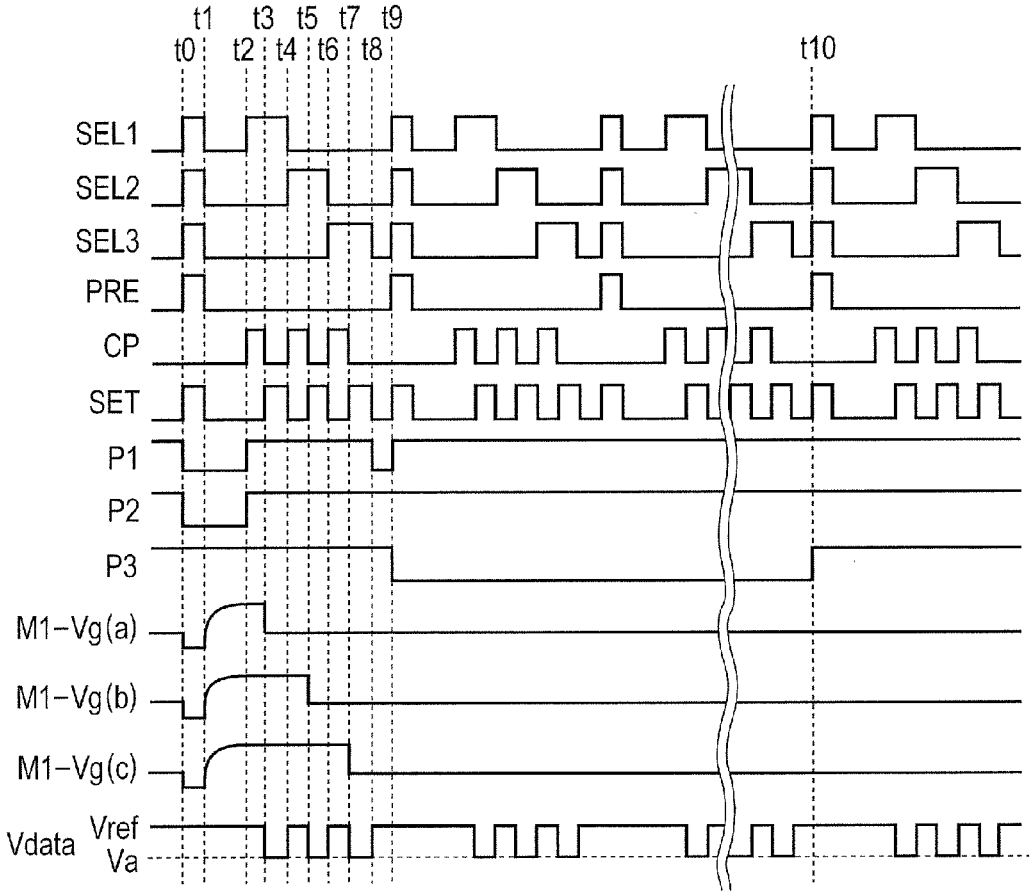
FIG. 8 is a timing chart corresponding to the pixel circuit and the control circuit of FIG. 6 in the fourth embodiment of the present invention.

FIG. 8 illustrates a timing chart according to the fourth embodiment. Here, it should be noted that the constitutions of the column control circuit 2 and the three-column and one-row pixel circuits 5 in the displaying region 1, according to the fourth embodiment, are the same as those described in the third embodiment (FIG. 6). Hereinafter, the points of the present embodiment different from the above embodiment will be described.

The present embodiment is different from the above embodiment in the following points. That is, when a gradation voltage Va is input as an input data voltage, a voltage programming is once performed so that a voltage according to the gradation voltage is written to the data line capacitor Cd, to which one block of the column control circuit 2 is connected, through the column control capacitor Cs and the voltage follower circuit B1. After then, the voltage according to the gradation voltage is written from the data line capacitor Cd of each data line to the gate of the driving transistor M1 and the storage capacitor Cp of the pixel circuit connected to each data line, with respect to each row.

In the period before a time t2, the operation same as that described in the third embodiment is performed. In the period from the time t2 until just before a time t4, the column control circuit 2 is connected to the data line dataA. In the period from the time t2 until just before a time t3, the threshold voltage of the driving transistor M1 of the pixel circuit a is written to the other end of the column control capacitor Cs through the voltage follower circuit B2. Then, in the period from the time t3 until just before the time t4, the voltage programming operation is performed. At this time, the P1 control signal line and the P2 control signal line in the pixel circuit are at an L level, whereby the switch transistors M2 and M3 are off. That is, the voltage according to the gradation voltage is written to the data line capacitor Cd of the data line dataA through the column control capacitor Cs and the voltage follower circuit B1.

In the period from the time t4 until just before a time t6, the column control circuit 2 is connected to the data line dataB. In the period from the time t4 until just before a time t5, the threshold voltage of the driving transistor M1 of the pixel circuit b is written to the other end of the column control capacitor Cs through the voltage follower circuit B2. Then, in the period from the time t5 until just before the time t6, the voltage according to the gradation voltage is written to the data line capacitor Cd of the data line dataB through the column control capacitor Cs and the voltage follower circuit B1.

In the period from the time t6 until just before a time t8, the column control circuit 2 is connected to the data line dataC. In the period from the time t6 until just before a time t7, the threshold voltage of the driving transistor M1 of the pixel circuit c is written to the other end of the column control capacitor Cs through the voltage follower circuit B2. Then, in the period from the time t7 until just before the time t8, the voltage according to the gradation voltage is written to the data line capacitor Cd of the data line dataC through the column control capacitor Cs and the voltage follower circuit B1.

In the period from the time t8 until just before a time t9, the P1 control signal line of the pixel circuit changes from an H level to an L level, and the switch transistors M2 of all the pixel circuits to which the P1 control signal line is connected changes from off to on. Thus, the voltage according to the gradation voltage is written from the data line capacitor Cd of each of the data lines to the gate of the driving transistor M1 and the storage capacitor Cp of each of the pixel circuits.

In also the present embodiment, it is possible by the circuit constitution and the circuit driving method both described above to have the same effect as that in the third embodiment.

Fifth Embodiment

Figure 9:
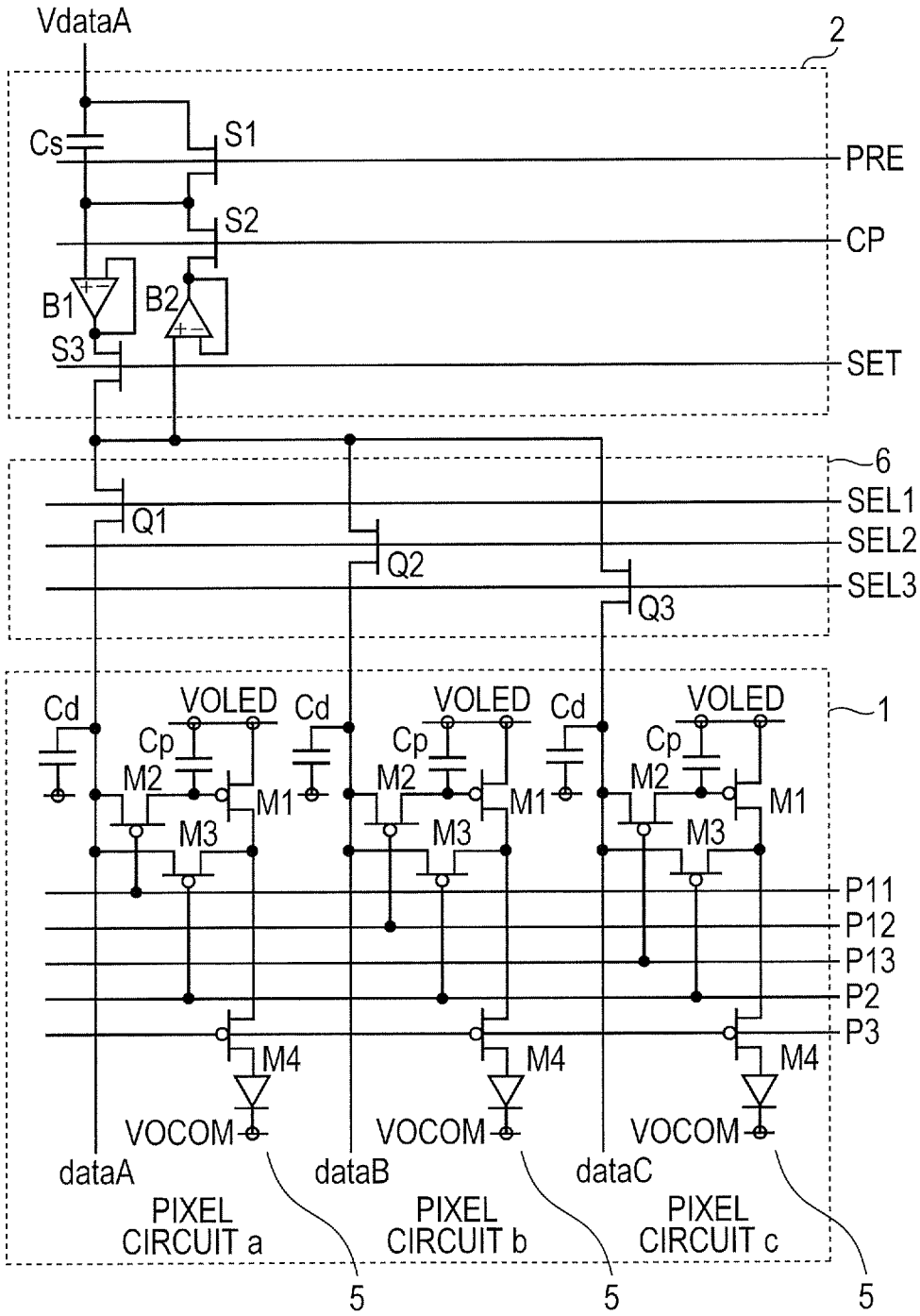
FIG. 9 is a block diagram illustrating a pixel circuit and a control circuit which are used in a fifth embodiment of the present invention.
Figure 10:
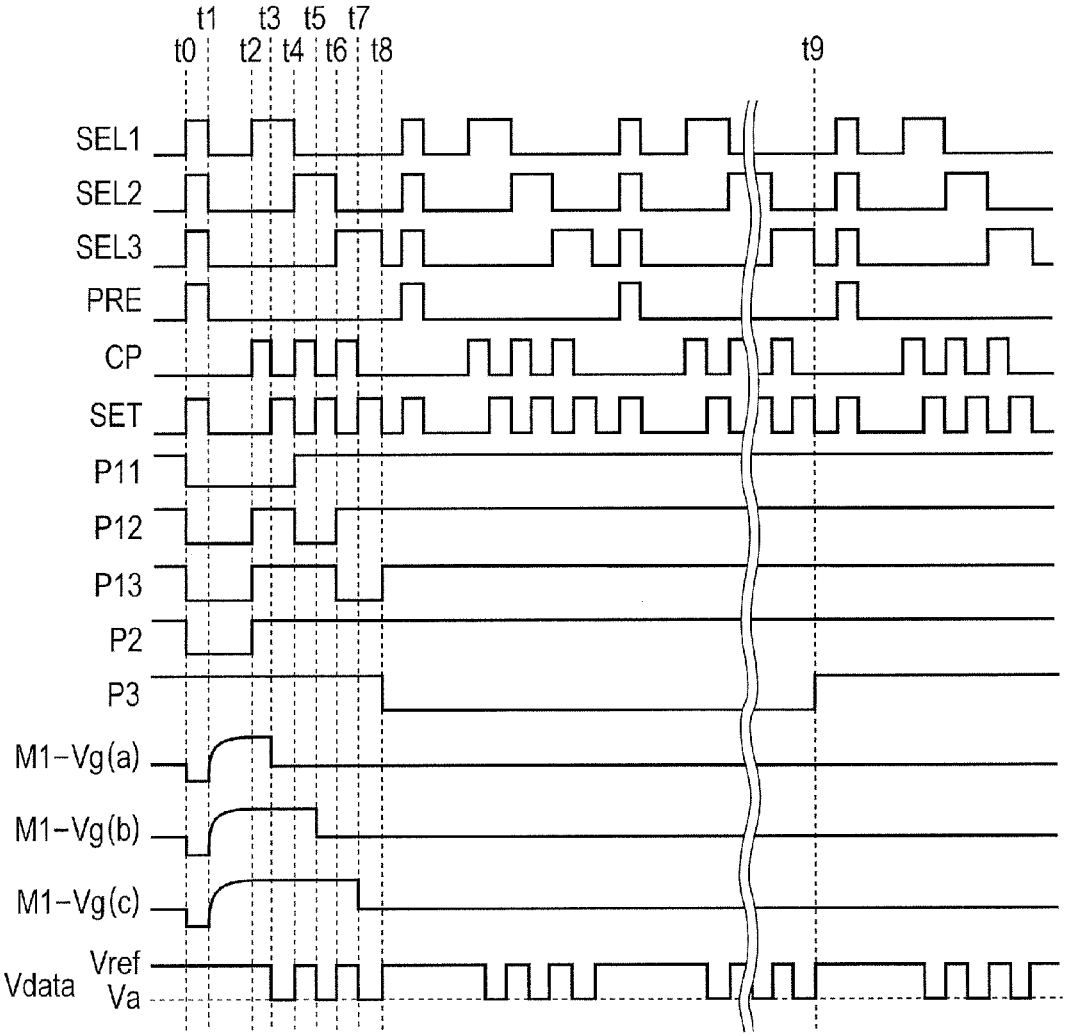
FIG. 10 is a timing chart corresponding to the pixel circuit and the control circuit of FIG. 9 in the fifth embodiment of the present invention.

FIG. 9 is a block diagram illustrating constitutions of a column control circuit 2, and three-column and one-row pixel circuits 5 (pixel circuits a, b, c) in a displaying region 1, according to the fifth embodiment. Further, FIG. 10 is a timing chart according to the fifth embodiment. Hereinafter, the points of the present embodiment different from the above embodiment will be described.

The present embodiment is different from the above embodiment in the point that the P1 control signal line in the above embodiment has been divided into a plurality of control signal lines (P11, P12 and P13 control signal lines) corresponding to the respective columns. Thus, the one block of the column control circuit 2 is connected in a switchable manner to one of the divided control signal lines. In other words, a switch transistor M2 of the pixel circuit of each column which is not selected in regard to the column control circuit 2 is set to be off.

Hereinafter, the circuit operation will be described by focusing attention to the pixel circuit a. In the period before a time t2, as well as the third embodiment, the precharge operation and the auto-zero operation are simultaneously performed for the three pixel circuits a to c. In the period from the time t2 until just before a time t4, the column control circuit 2 is connected to a data line dataA. In the period from the time t2 until just before a time t3, the threshold voltage of a driving transistor M1 of the pixel circuit a is written to the other end of a column control capacitor Cs through a voltage follower circuit B2. In the period from the time t3 until just before the time t4, a switch transistor M2 of the pixel circuit a is on, and the voltage programming operation is performed. Thus, a voltage according to the gradation voltage is written to the gate of the driving transistor M1 and a storage capacitor Cp, through the column control capacitor Cs and a voltage follower circuit B1. In the period from the time t4 until just before a time t6, the column control circuit 2 is connected to a data line dataB. In the period from the time t4 until just before a time t5, the threshold voltage of a driving transistor M1 of the pixel circuit b is written to the other end of the column control capacitor Cs through the voltage follower circuit B2. In the period from the time t5 until just before the time t6, the voltage programming operation is performed in regard to the pixel circuit connected to the data line dataB, whereby a voltage according to the gradation voltage is written to the gate of a driving transistor M1 and a storage capacitor Cp, through the column control capacitor Cs and the voltage follower circuit B1. In the period from the time t6 until just before a time t8, the column control circuit 2 is connected to a data line dataC. In the period from the time t6 until just before a time t7, the threshold voltage of a driving transistor M1 of the pixel circuit c is written to the other end of the column control capacitor Cs through the voltage follower circuit B2. In the period from the time t7 until just before the time t8, the voltage programming operation is performed in regard to the pixel circuit connected to the data line dataC, whereby a voltage according to the gradation voltage is written to the gate of a driving transistor M1 and a storage capacitor Cp, through the column control capacitor Cs and the voltage follower circuit B1.

In the pixel circuit a which is connected to the data line dataA, at the time t4, the P11 control signal line changes from an L level to an H level, and the switch transistor M2 is off. Therefore, it is set that the switch transistor M2 only in the pixel circuit which is selected by and connected to the column control circuit 2 is on and the switch transistors M2 in other pixel circuits which are not selected are off. That is, the switch transistor M2 is off in the period other than the period in which the pixel circuit is connected to the column control circuit 2 and the voltage according to the gradation voltage is written to the gate of the driving transistor M1 and the storage capacitor Cp through the column control capacitor Cs and the voltage follower circuit B1, whereby it is possible to accurately store and hold the voltage according to the gradation voltage in the storage capacitor Cp.

In the present embodiment, it is possible by the circuit constitution and the circuit driving method both described above to have the same effect as that in the third embodiment. For example, when the light emitting device which has luminance efficiency different from others is are used in the pixel circuit for each column, it is possible to optimize displaying quality by setting the current at the time when the auto-zero operation terminates according to the current necessary for emitting light in each light emitting device. At this time, by controlling the operation so that the auto-zero time is different for each column, it is possible to adjust the current at the time when the auto-zero operation terminates.

Sixth Embodiment

Figure 11:
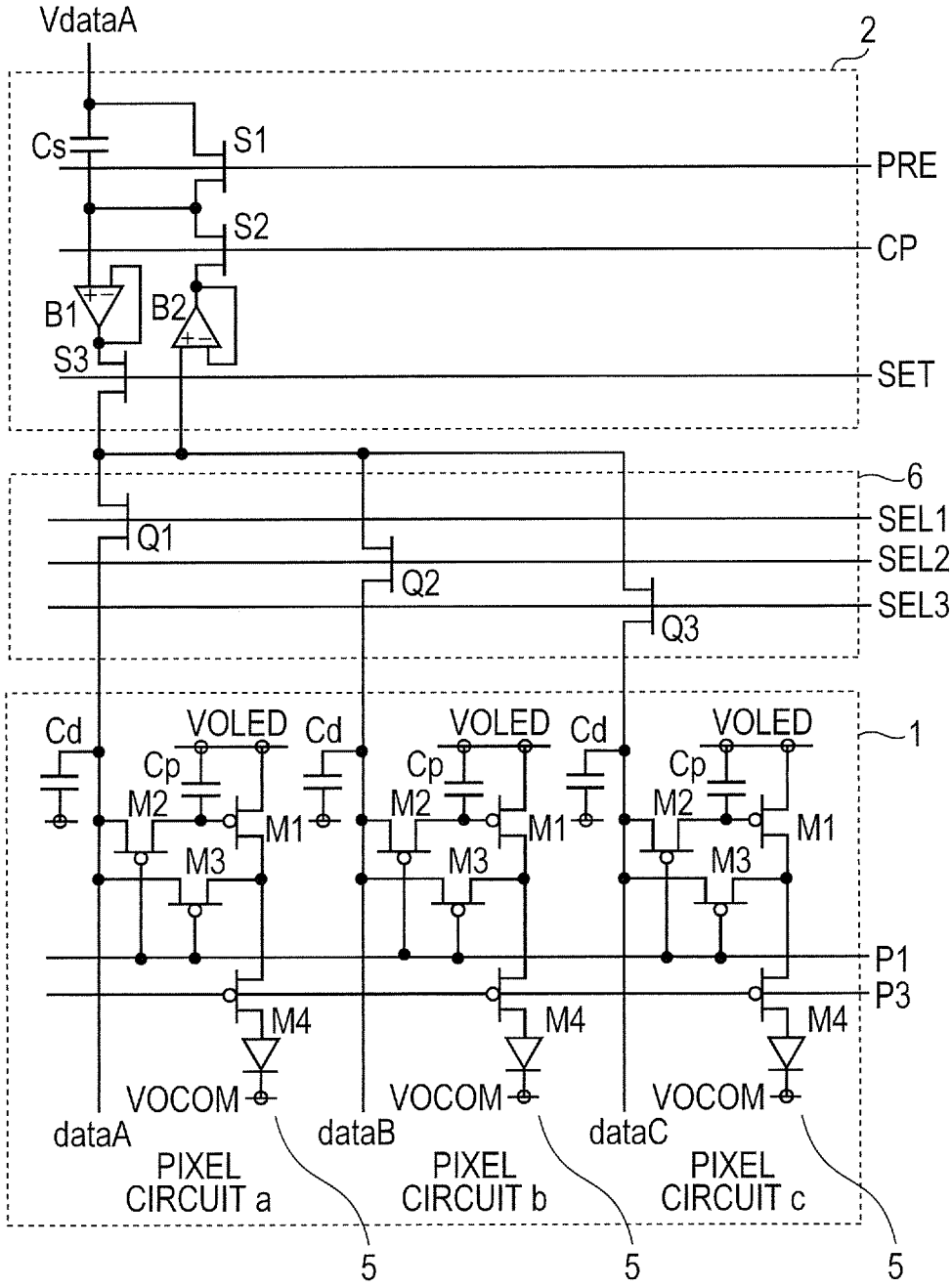
FIG. 11 is a block diagram illustrating a pixel circuit and a control circuit which are used in a sixth embodiment of the present invention.
Figure 12:
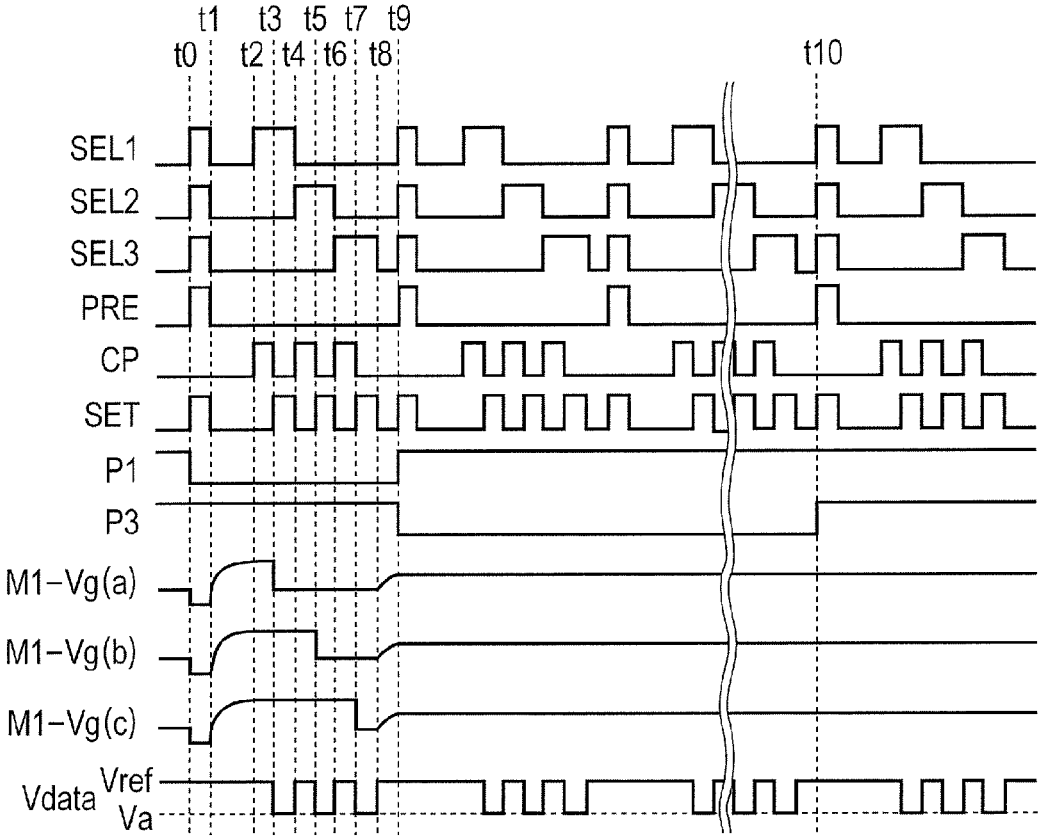
FIG. 12 is a timing chart corresponding to the pixel circuit and the control circuit of FIG. 11 in the sixth embodiment of the present invention.

FIG. 11 is a block diagram illustrating constitutions of a column control circuit 2, and three-column and one-row pixel circuits 5 (pixel circuits a, b, c) in a displaying region 1, according to the sixth embodiment. Further, FIG. 12 is a timing chart according to the sixth embodiment. Hereinafter, the points of the present embodiment different from the above embodiment will be described.

The present embodiment is different from the above embodiment in the point that the voltage programming operation is performed when the gate and the drain of a driving transistor M1 are in a short circuit condition. That is, it is possible in the present embodiment to perform an operation for cancelling variation in a current driving capability (β) of the driving transistor M1 [β correction operation].

More specifically, switch transistors M2 and M3 are controlled by using a P1 control signal line. In the period before a time t8, the operation same as that in the fourth embodiment is performed, and a voltage according to the gradation voltage to be written to each pixel circuit is written to a data line capacitor Cd of each data line through a column control capacitor Cs and a voltage follower circuit B1. In the period from the time t8 until just before a time t9, the P1 control signal line changes from an H level to an L level, and the switch transistors M2 and M3 change from off to on. Consequently, the gate and the drain of the driving transistor M1 come to be in the short circuit condition. Further, a voltage according to the data voltage written to the data line capacitor Cd of each data line is written to the gate of the driving transistor M1 of the pixel circuit. At this time, the gate voltage and the drain voltage increase according to the current driving capability (β) of the driving transistor M1 until just before the time t9. That is, it is possible to cancel the variation in the current driving capability (β) of the driving transistor.

Also in the present embodiment, it is possible by the circuit constitution and the circuit driving method both described above to have the same effect as that in the fourth embodiment. Further, in the present embodiment, it is possible to achieve the superior displaying apparatus of which the displaying quality is less spoiled as compared with the conventional displaying apparatus, because the variation in the current driving capability (β) of the driving transistor M1 can be cancelled.

Incidentally, as the transistors which have been described in the above embodiments, it is possible to apply an amorphous silicon thin film transistor, a polysilicon thin film transistor, a monocrystal silicon transistor, and the like.

Further, it should be noted that the present invention is not limited to the above-described embodiments. That is, by an embodiment which is obtained by properly combining the above-described embodiments, it is possible to have the effects same as those described above.

Incidentally, an information displaying apparatus can be constituted by using the above displaying apparatus. The information displaying apparatus thus constituted is achieved in the form of a mobile phone, a mobile computer, a digital still camera or a video camera. Moreover, the information displaying apparatus may be an apparatus which can achieve a plurality of such functions.

Figure 13:
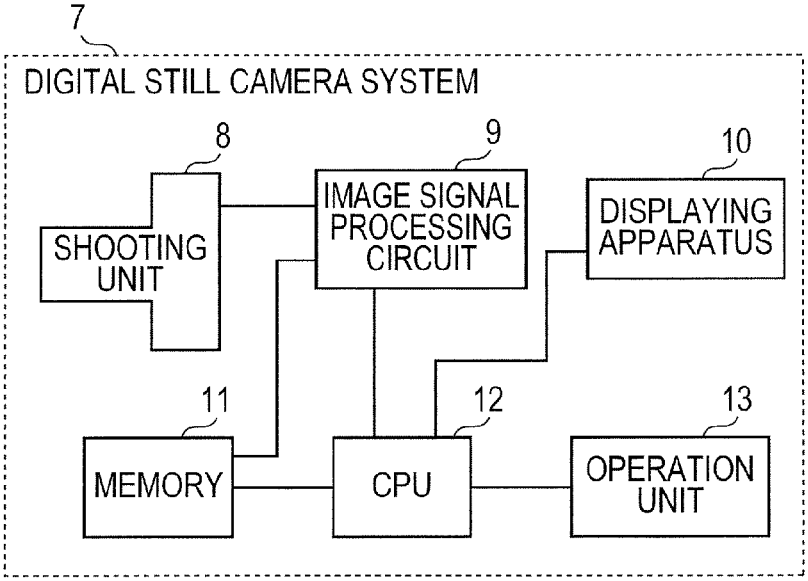
FIG. 13 is a block diagram illustrating an entire constitution of a digital still camera which uses the displaying apparatus according to the present invention.

FIG. 13 is a block diagram illustrating an example of a digital still camera which uses the displaying apparatus according to the present invention. That is, a digital still camera system 7 includes a shooting unit 8, an image signal processing circuit 9, a displaying apparatus 10 according to the present invention, a memory 11, a CPU 12, and an operation unit 13. In this system, an image which is shot by the shooting unit 8 or an image which has been recorded in the memory 11 is transferred to the image signal processing circuit 9, and subjected to a signal process. Then, the obtained image can be seen on the displaying apparatus 10 such as a display panel or the like. Here, a controller has the CPU 12 for controlling the shooting unit 8, the memory 11, the image signal processing circuit 9 and the like in response to an instruction input from the operation unit 13, whereby shooting, recording, reproducing and displaying which are suitable for circumstances can be performed. In addition, the displaying apparatus 10 can be used as a displaying unit for displaying various kinds of electronic devices.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-278844, filed Dec. 20, 2011, which is hereby incorporated by reference herein in its entirety.

What is claimed is:

1. A displaying apparatus which comprises a plurality of pixel circuits, a data line configured to supply a voltage to the plurality of pixel circuits, and a control circuit connected to the data line, wherein each of the plurality of pixel circuits includes a light emitting device, a driving transistor configured to supply to the light emitting device a current according to the voltage applied to a gate electrode thereof, a first capacitor of which one end is connected to the gate electrode of the driving transistor, a first switch transistor configured to control conduction between the gate electrode of the driving transistor and the data line, and a second switch transistor configured to control conduction between a drain electrode of the driving transistor and the data line, and the control circuit is arranged on an outer side of a region in which the plurality of pixel circuits are arranged, and the control circuit includes a second capacitor in which an input data signal is supplied to one end thereof, a first voltage follower circuit of which an input is connected to the other end of the second capacitor and of which an output is connectable to the data line, and a second voltage follower circuit of which an input is connected to the data line and of which an output is connectable to the other end of the second capacitor.

2. The displaying apparatus according to claim 1, wherein the data line is connected commonly to the first switch transistors included in predetermined pixel circuits among the plurality of pixel circuits.

3. The displaying apparatus according to claim 1, wherein the displaying apparatus includes the plurality of control circuits and the plurality of data lines, and the control circuit is provided for each data line.

4. The displaying apparatus according to claim 1, wherein the control circuit is provided for the plurality of data lines, and a switch circuit is provided between the control circuit and the plurality of data lines to selectively connect the control circuit and one of the plurality of data lines with each other.

5. The displaying apparatus according to claim 4, further comprising a gate line driving circuit configured to supply a control signal to a control signal line connected to the first switch transistors of the plurality of pixel circuits, wherein the plurality of pixel circuits are two-dimensionally arranged in row and column directions, the data line is arranged in the column direction and the control signal line is arranged in the row direction, and the control signal line is connected commonly to the first switch transistors included in the plurality of pixel circuits arranged in the row direction.

6. The displaying apparatus according to claim 5, wherein the control signal line, which is connected commonly to the first switch transistors included in the plurality of pixel circuits arranged in the row direction, is also connected commonly to the second switch transistors included in the plurality of pixel circuits arranged in the row direction.

* * * * *